US006819906B1

(12) United States Patent
Herrmann et al.

(10) Patent No.: US 6,819,906 B1
(45) Date of Patent: Nov. 16, 2004

(54) PRINTER OUTPUT SETS COMPILER TO STACKER SYSTEM

(75) Inventors: Douglas K. Herrmann, Webster, NY (US); Bruce D. Caryl, Fairport, NY (US); Timothy M. Davis, Macedon, NY (US); Richard P. Ficarra, Macedon, NY (US); Richard J. Milillo, Fairport, NY (US); Matthew J. Ross, Walworth, NY (US); Alicia K. Schwenk, Penfield, NY (US); Piotr Sokolowski, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/652,106

(22) Filed: Aug. 29, 2003

(51) Int. Cl.[7] ..... G03G 15/00

(52) U.S. Cl. ..... 399/368; 399/361; 399/403; 400/624; 400/626; 270/58.11; 270/58.13

(58) Field of Search ..... 399/403, 404, 399/405, 362, 369, 377, 361; 400/624, 626, 627, 628; 270/58.11, 58.13, 30.05

(56) References Cited

U.S. PATENT DOCUMENTS 4,871,158 A 10/1989 May et al.
5,098,074 A 3/1992 Mandel et al.
5,289,251 A 2/1994 Mandel et al.
5,409,201 A 4/1995 Kramer
5,470,050 A 11/1995 Anma
5,649,695 A 7/1997 Lawrence
5,685,529 A 11/1997 McFarland
5,951,000 A * 9/1999 Sato et al. ..... 270/58.11
6,330,999 B2 12/2001 Coombs et al.
6,382,614 B1 * 5/2002 Fukatsu et al. ..... 270/58.11
6,592,113 B1 * 7/2003 Asao ..... 270/58.07
6,722,650 B1 * 4/2004 Abbata et al. ..... 271/213

* cited by examiner

*Primary Examiner*—Andrew H. Hirshfeld
*Assistant Examiner*—Dave A. Ghatt

(57) ABSTRACT

A sheets sets compiling and stacking system for the output of a printer, in which the seriatim output of printed sheets may be accumulated and neatly stacked on a temporary sheets supporting system until the desired number of sheets for that set (e.g. all the pages of a collated document) is accumulated (compiled). The temporary sheets supporting system may then automatically open to drop each completed or compiled set of sheets, but with positive alternate side set clamping control against sheet scattering or skewing, dropping only one side of one set at a time, by a short distance, down onto a multiple sets stacking system, such as a self-lowering elevator stacking tray, so as to provide reduced set scattering or skewing of the sheets within the sets, and/or between sets.

14 Claims, 9 Drawing Sheets

PRINTER OUTPUT SETS COMPILER TO STACKER SYSTEM

Cross-reference and incorporation by reference, where appropriate, is made to the following co-pending and commonly-assigned patent applications: U.S. application Ser. No. 10/361,345, filed Feb. 7, 2003, "Finishing Device Having a Sheet Guiding and Buffering Mechanism," by Richard J. Milillo, et al; U.S. application Ser. No. 10/248,822, filed Feb. 21, 2003, "Systems and Methods for Trail Edge Paper Suppression for High-Speed Finishing Applications," by Salvatore A. Abbata et al; U.S. application Ser. No. 10/249,644, filed Apr. 28, 2003, "Multifunction Paper-Path Gate Selector and Sheet Restraint," by Jesse J. Brumberger et al; and U.S. application Ser. No. 10/604,013, filed Jun. 20, 2003, "Compiling Platform to Enable Sheet and Set Compiling and Method of Use," by Richard J. Milillo et al.

Disclosed in the embodiment herein is an improved system and method for the transferring of compiled sheet sets from a compiling system to a compiled sets stacking system, with reduced tendencies for sheet scattering and thus providing more neatly and directly superposed sheets in the set, especially for unbound sets. Yet it allows a relatively simple and gravity based transition of the sets from a sheets compiling area to the separate compiled sheet sets stacking area.

Various types of output or "finishing" systems or modules are known in the art, including those in which the output of a printer which can provide pre-collated, for example, page order printed sheets may be on-line compiled (accumulated in a superposed set) into completed sets of plural sheets. The compiled sets may, or may not, be stapled or otherwise bound together. Then each compiled set may be automatically dropped, pushed out, or otherwise stacked on a stack of previously compiled sets, typically on an automatic level elevator tray or removable container, for convenient collection and subsequent removal. The following Xerox Corp. U.S. patent disclosures, and other art cited therein, are noted merely by way of some examples: U.S. Pat. No. 5,098,074 issued Mar. 24, 1992; U.S. Pat. No. 5,289,251 issued Feb. 22, 1994; U.S. Pat. No. 5,409,201 issued Apr. 25, 1995; and U.S. Pat. No. 5,685,529 issued Nov. 11, 1997.

In particular, there is noted Xerox Corp. U.S. Pat. No. 4,871,158 issued Oct. 3, 1989. Also, for example, U.S. Pat. No. 5,649,695 discloses a sheet stacker and finisher apparatus in which a multi-page set of sheets delivered from a copier or printer are collected at an assembly station. During the feeding of sheets comprising the set of sheets, a jogger is actuated to align side edges and to register the trail edges against a backstop and on an assembly bar. The sheet feeding and jogging continues until a complete set of sheets has been assembled. Upon completion of a set of sheets, the feeding of further sheets from the copier or printer is interrupted until the trail edge of the set of sheets is clamped or gripped and the set of sheets removed from the assembly station. At this time a subsequent set of sheets may be fed from the copier or printer onto the assembly station, while the previous set of sheets is being stapled and then stored on a storage table. Thus, less time is lost, because the interruption in sheets being fed to the sheet stacker and finisher is only for a relatively short time and not for completion of the finishing of the prior set of sheets.

The sheet handling system embodiment disclosed herein provides improved sheet alignment and stacking control, with productivity suitable for high volume finishing, and also enabling a minimum "footprint" or lateral space requirement. It can also handle a wide range of weight, condition and beam strength sheets. It can also enable, as shown, "on line" compiling and finishing of sets of sheets received directly seriatim (sequentially) from the output of even a high speed printer, or various other document creating apparatus.

As shown, the output of seriatim printed sheets may be accumulated and neatly stacked on a temporary sheets supporting system until the desired number of sheets for that set (for example, all the pages of a collated document) is accumulated (compiled). The temporary sheets supporting system may then automatically open to drop each completed or compiled set of sheets (one set at a time), but with positive alternate side set clamping control against sheet scattering or skewing, dropping only one side of the set at a time, by a short distance, down onto a multiple sets stacking system, such as the illustrated self-lowering elevator stacking tray system, so as to provide reduced set scattering or skewing of the sheets or the sets as compared to less controlled systems.

One feature of the specific embodiment disclosed herein is to provide a method of neatly compiling and stacking print media sheets in discrete sets of said print media sheets comprising seriatim receiving and stacking plural print media sheets on a print media sheets compiling and temporary set supporting system until a desired plural number of said print media sheets defining a single said set thereof has been accumulated on said temporary set supporting system, gripping a first end of said set of print media sheets, dropping a second and opposite end of said set of print media sheets onto a multiple sets stacking system positioned underneath said print media sheets temporary set supporting system by opening said temporary set supporting system while continuing to grip said first end of said set of print media sheets, to reduce sheet or set scattering, gripping said second and opposite end of said set of print media sheets at said multiple sets stacking system; and then dropping said first end of said set of print media sheets from said temporary set supporting system onto said multiple sets stacking system while continuing to grip said second and opposite end of said set of print media sheets, to reduce sheet or set scattering.

Further specific features disclosed in the embodiment herein, individually or in combination, include those wherein said print media sheets set may be additionally fastened together in said print media sheets compiling and temporary set supporting system; and/or wherein said print media sheets compiling and temporary set supporting system includes a partial supporting shelf for said first end of said set of print media sheets for accomplishing said gripping of said first end of said set of print media sheets by clamping said first end of said set of print media sheets against first end supporting shelf, and/or wherein said print media sheets compiling and temporary set supporting system includes print media sheet side supporting members that open away from one another to drop said set of print media sheets therebetween, and/or wherein said print media sheets compiling and temporary set supporting system includes print media sheet set side supporting members that open away from one another to drop said set of print media sheets therebetween, and/or a system for neatly compiling and stacking print media sheets in sets of plural said print media sheets, comprising a print media sheets compiling and set supporting system for seriatim receiving and stacking plural print media sheets on said set supporting system until a desired plural number of said print media sheets defining a single said set thereof has been accumulated on said set supporting system, means for gripping a first end of said set of print media sheets on said set supporting system, a multiple sets stacking system positioned below said print media sheets compiling and set supporting system, means for dropping a second and opposite end of said set of print media sheets onto said multiple sets stacking system by opening said set supporting system while continuing to grip said first end of said set of print media sheets, means for gripping said second and opposite end of said set of print media sheets; and means for subsequently dropping said first end of said set of print media sheets onto said multiple sets stacking system while continuing to grip said second and opposite end of said set of print media sheets, and/or further including a set fastening system for optionally fastening said set of plural print media sheets together, and/or wherein said print media sheets compiling and set supporting system includes a partial set supporting shelf for said first end of said set of print media sheets, and said means for gripping said first end of said set of print media sheets grips said first end of said set of print media sheets against said partial set supporting shelf, and/or wherein said print media sheets compiling and temporary set supporting system includes at least two print media sheet side supporting members that open horizontally away from one another to drop said set of print media sheets therebetween, and/or a system for neatly compiling and stacking print media sheets in multiple sets of plural said print media sheets on a multiple sets stacking system comprising a print media sheets compiling and temporary set supporting system for seriatim receiving and stacking a set of plural print media sheets on said temporary set supporting system, said multiple sets stacking system being positioned below said print media sheets temporary set supporting system, a first clamping system actuatable to clamp a first end of said set of plural print media sheets on said temporary set supporting system, said print media sheets temporary set supporting system being openable to drop a second and opposite end of said set of plural print media sheets onto said multiple sets stacking system while said first clamping system is actuated to clamp said first end of said set of plural print media sheets, a second clamping system for clamping said second and opposite end of said set of plural print media sheets; and said first clamping system being actuatable to release said first end of said set of plural print media sheets to drop said first end of said set of plural print media sheets onto said multiple sets stacking system while said second clamping system is clamping said second end of said set of plural print media sheets, and/or wherein said print media sheets temporary set supporting system includes a partial set supporting shelf for said first end of said set of print media sheets, which partial set supporting shelf is part of said first clamping system, and/or wherein said print media sheets temporary set supporting system includes print media sheet opposing side supporting members that open away from one another to drop said set of print media sheets therebetween, and/or wherein said print media sheets compiling and temporary set supporting system sequentially compiles said print media sheets on said temporary set supporting system and further includes a set finishing system for binding individual said sets of plural print media sheets together thereon, and/or wherein multiple sets of plural said print media sheets stacked on said multiple sets stacking system are stacked offset from one another by offsetting of at least a portion of said print media sheets compiling and temporary set supporting system.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, any disclosed control system or method may be implemented partially or fully in hardware, using standard logic circuits or single chip VLSI designs.

The term "printer" or "reproduction apparatus" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for printing images thereon, whether precut or initially web fed. A complied collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operations or methods described in the example below, and the claims. Thus, the present invention will be better understood from this description of this specific embodiment, including the drawing figures (which are approximately to scale) wherein:

FIG. 1 is a partial or simplified schematic frontal view of an exemplary compiler/finisher/set stacker system for the printed sheets output of a printer, showing incoming sheets being compiled and tamped on retractable side edge shutters and trail edge (TE) and lead edge (LE) supporting shelves defining a temporary set supporting compiling and finishing station, which as shown is spaced above a previously compiled set stacked on an elevator stacking tray defining a multiple sets stacking system;

FIG. 2 is the same as FIG. 1, except for removal of the overlying incoming sheets transport for illustrative clarity, but showing a next step, in which the set of plural printed sheets has now been fully completed and (optionally) stapled and is about to be ejected while the trail edge area of that set is moved fully onto the TE supporting shelf, and off of any LE shelf, and a TE set clamp is being activated as shown by the movement arrow;

Figure 1:
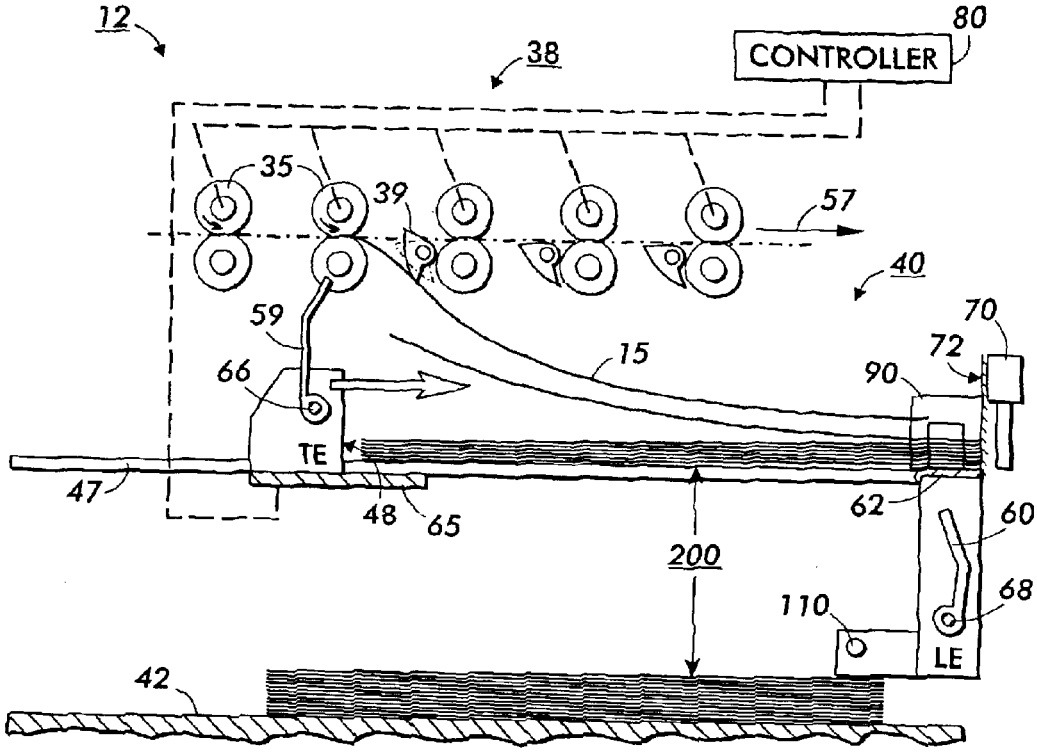
Figure 7:
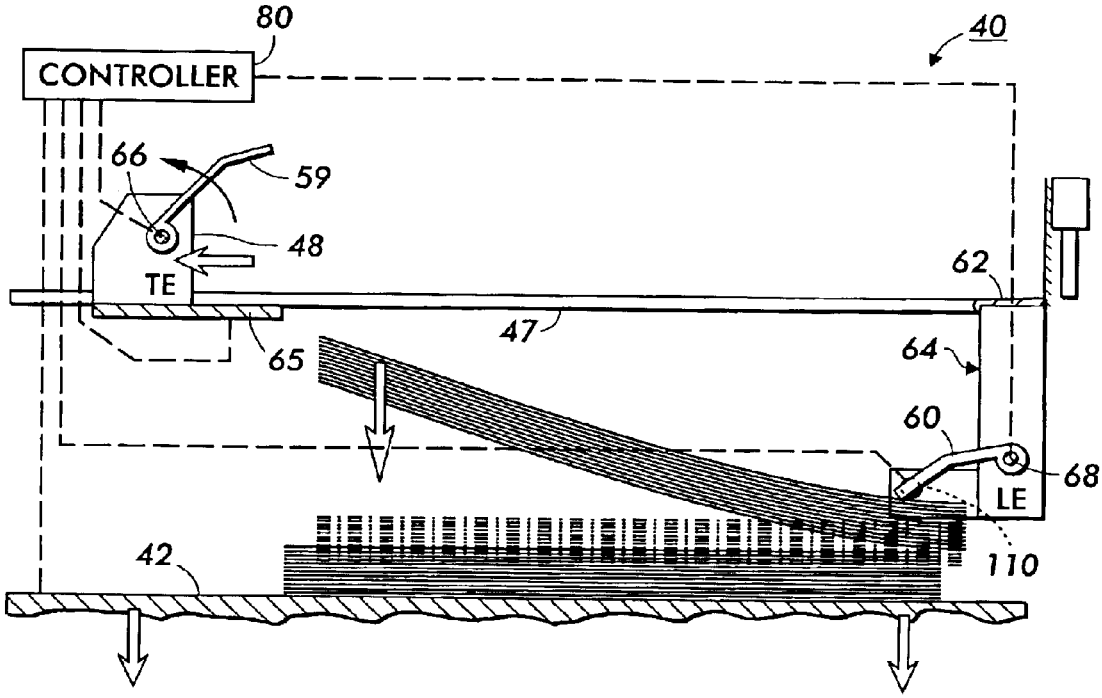
Figure 8:
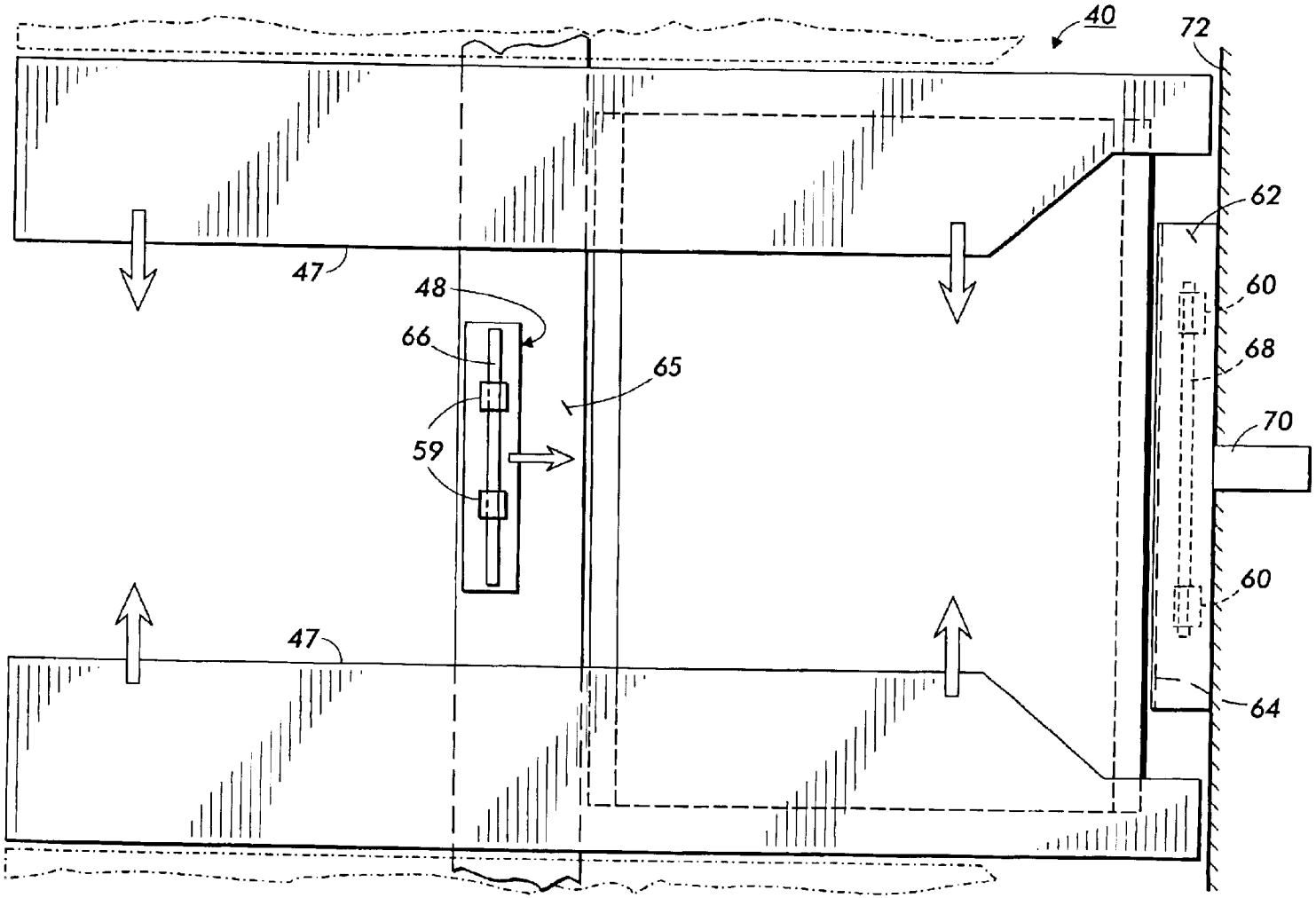
Figure 9:
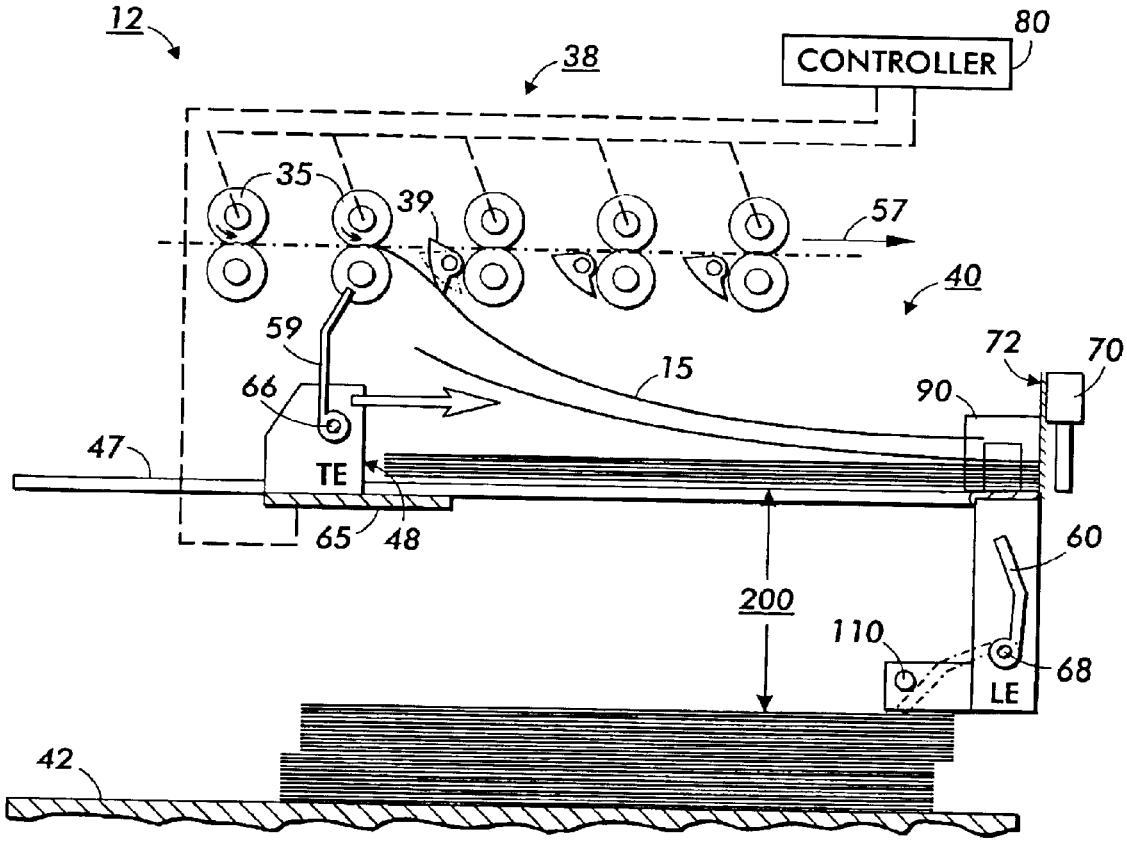
Figure 10:
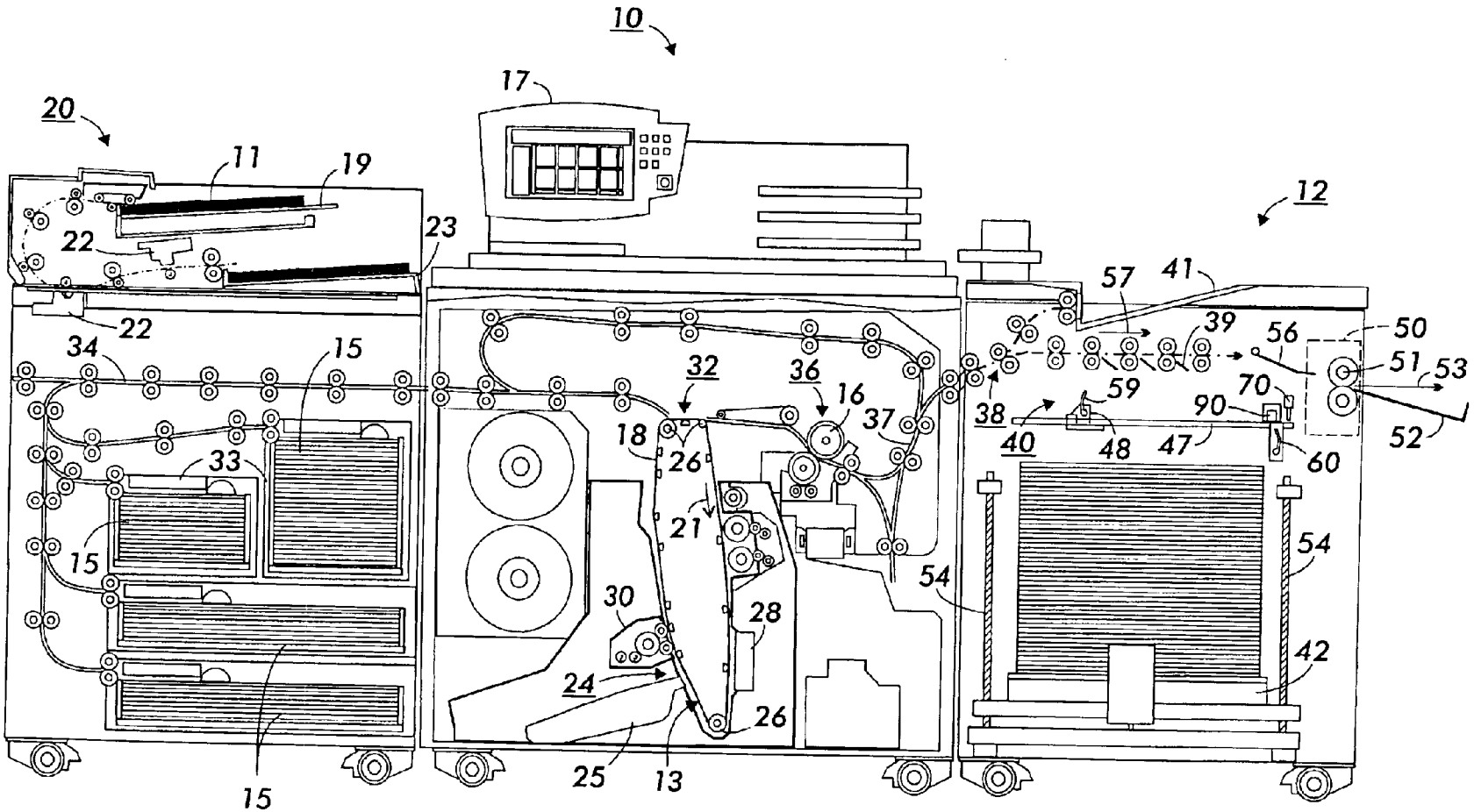
Figure 11:
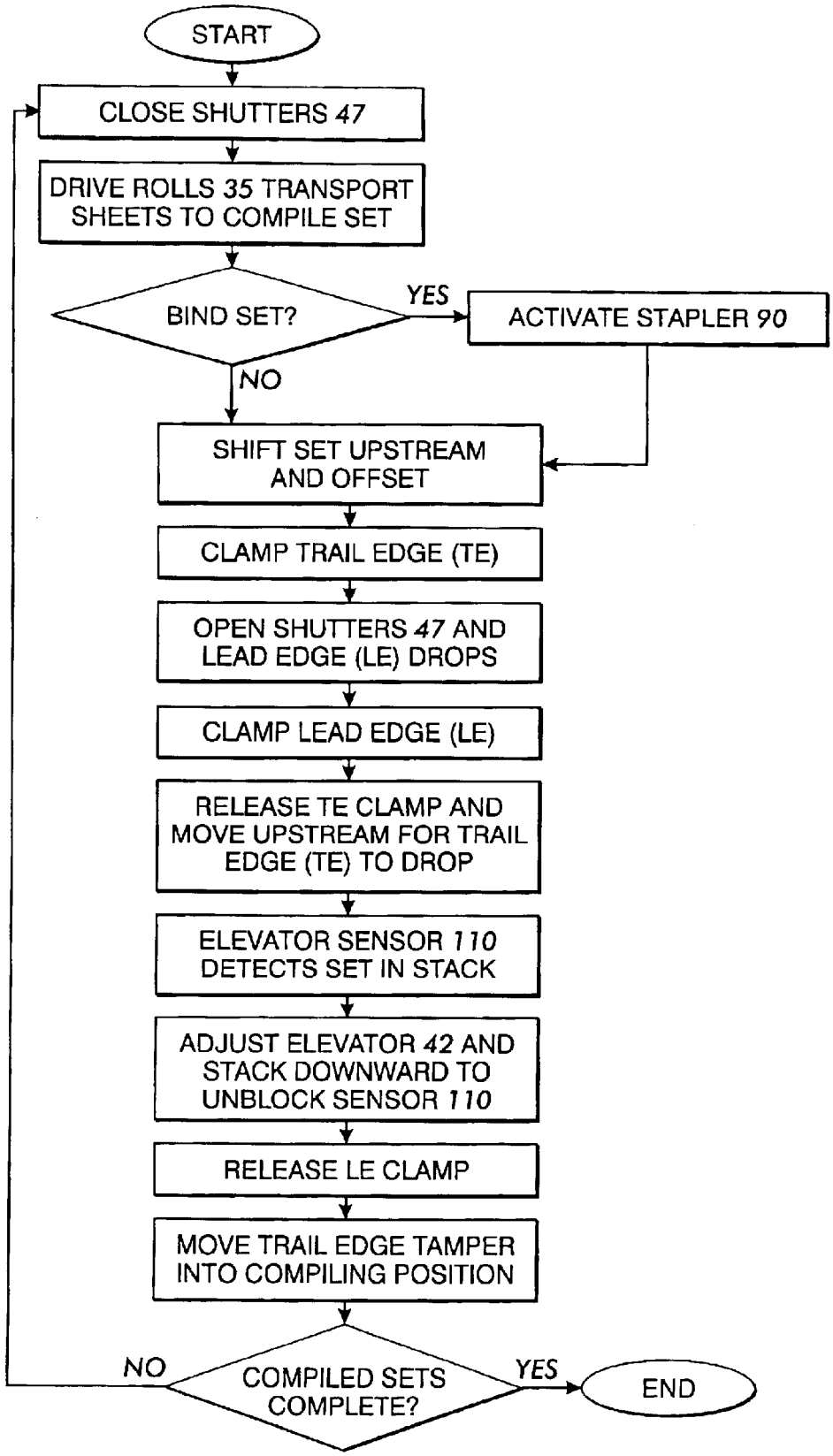

FIG. 7 is the same as FIGS. 1, 2, 4 and 5, showing the next step in the controlled set drop (by the movement arrow and the solid line to phantom line positions for the set), in which the TE clamp has opened and the TE shelf and tamper is retracted to release the set TE to drop down onto the set stacking system, which is moving down, while the LE of the set is clamped by the LE clamp for continued positive set dropping control;

FIG. 8 is a top view of FIG. 7, showing with movement arrows that the compiler shutters and LE shelf may now move back in to their initial set compiling position to start receiving more individual sheets from the output of a printer;

FIG. 9 is the same as FIG. 1, showing the compiling of the next set in the next cycle of set compiling and stacking;

FIG. 10 shows the subject exemplary compiler/finisher/set stacker system in a modular unit connected to the output of an exemplary xerographic printer; and FIG. 11 is a flowchart illustrating the steps of FIGS. 1-8, and 9.

Referring first to FIG. 10, there is shown a schematic front elevational view of one example of the subject finishing system, station, or module 12 incorporating (as shown in more detail in other Figures) an exemplary sheet compiling station or system 40, an (optional) finisher example of a conventional set stapler 90, and an exemplary compiled sets stacking tray system 42. The finishing system 12 is shown here in FIG. 10 directly adjacent to (or integral) an exemplary high-speed, high-volume document creating apparatus 10, such as, for example, the xerographic printer shown here, from which a series of printed sheets with image reproductions thereon may be directly fed seriatim to the finishing system 12 for production of desired sets of these printed sheets, normally collated sets.

Referring further to the FIG. 10 printer 10, as in other xerographic machines, and as is well known, an electronic document or an electronic or optical image of an original document or set of documents to be reproduced may be projected or scanned onto a charged surface 13 of a photoreceptor belt 18 to form an electrostatic latent image. Optionally, a document handler 20 may be provided to scan at a scanning station 22 paper documents 11 fed from a tray 19 to a tray 23. The latent image is developed with developing material to form a toner image corresponding to the latent image. The toner image is then electrostatically transferred to a final print media material, such as paper sheets 15, to which it may be permanently fixed by a fusing device 16. The machine operator may enter the desired printing and finishing instructions through the control panel 17, or, with a job ticket, an electronic print job description from a remote source, or otherwise.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to the finishing station 12 where plural sheets 15 may be accumulated to be compiled into superposed sets of sheets and optionally fastened together (finished) by being stapled, bound, or the like.

Referring now to the other Figures, such as FIG. 1, et al, the exemplary finishing station 12 here comprises an overlying sheet transport 38 with plural sheet feed rollers 35 and plural diverter gate baffles 39, a sheet compiling system 40, an optional finishing (stapling) station 90, and an elevator stacking tray 42 for stacking and storing finished sets of sheets. The sheet transport 38 receives and transports sheets 15 from the printer 10 along a paper path indicated by arrow 57 to a selected and actuated one of the plural spaced diverter gate baffles 39 extending over the compiling area. Which sheet diverter gate 39 is actuated my be controlled depending on the sheet dimension in its feeding path direction 57. The actuated diverter gate baffle 39, in cooperation with the drive rollers 35 of the transport 38, diverts and deposits each sheet 15 sequentially onto the compiling system 40 as shown in FIG. 1.

Figure 3:
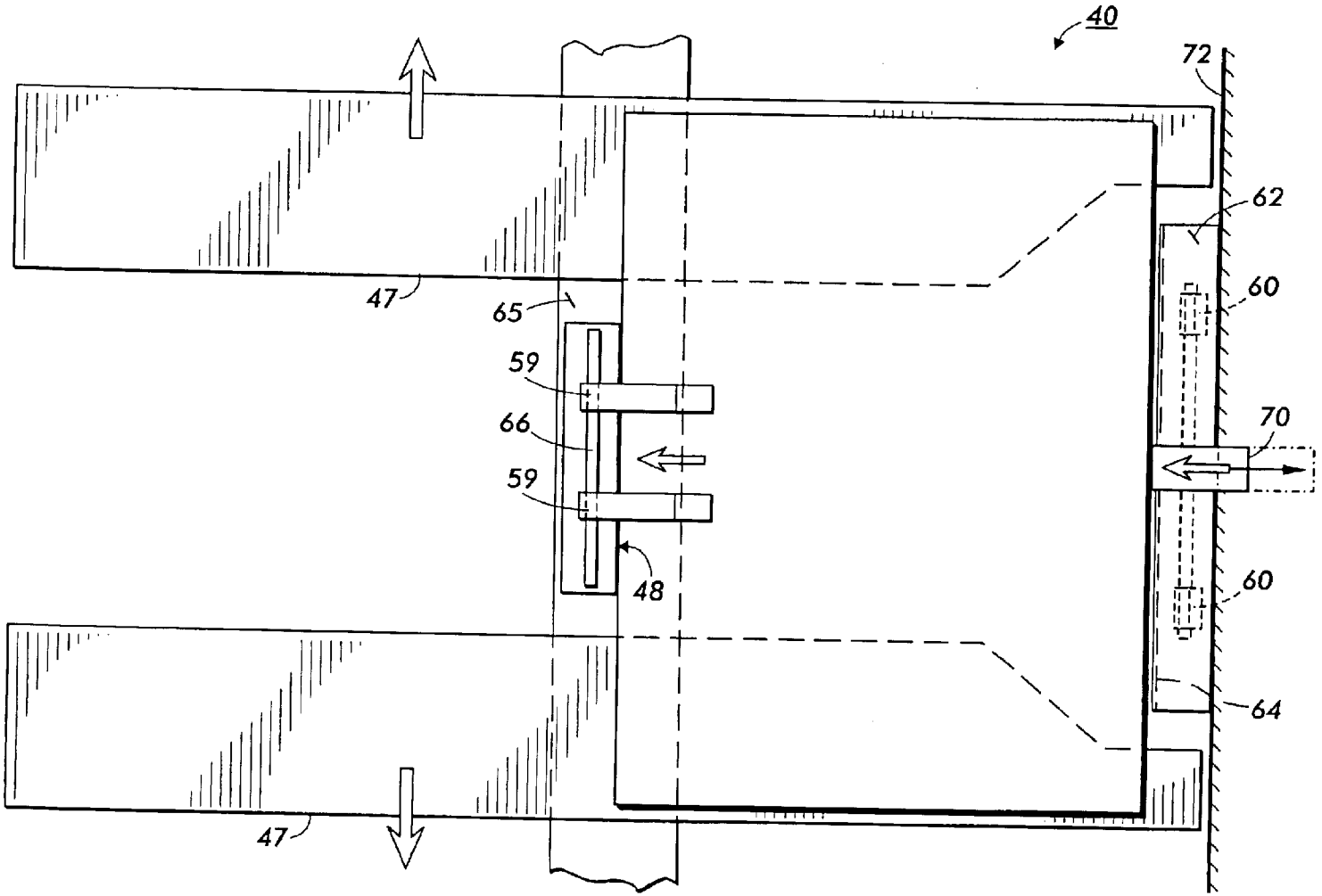
FIG. 3 is a top view of the system of FIGS. 1 and 2 shown in the operational position of FIG. 2, further illustrating the start of the lateral movement of the partial (side edges) sheet supporting shutters away from one another.

As also shown in the top views of FIGS. 3 and 8, for example, the sheet compiling system 40 includes two elongated (in the sheet entry movement direction) retractable platforms which are partial sheet supporting members or shutters 47. Each shutter 47 is horizontally (laterally) retractable, by a solenoid or other drive system, and each shutter 47 has an upper surface onto which sheets are deposited by the transport 38. These partial sheet supporting shutter 45 surfaces may have slight curvatures along their length to cause the sheet or sheets deposited thereon to partially conform to that curvature and create some added corrugation beam strength that will help prevent the sheets from buckling, sagging, or slipping down in between the two shutters 47 prematurely.

The sheet compiling system 40 here also includes a retractable horizontal trail edge platform or shelf 65 with a vertical trail edge tamper surface 48, and otherwise conventional stack side tampers (not shown, for illustrative clarity), for sheet alignment into a fully superposed and aligned compiled set. Multiple sheets 15 may thus be sequentially stacked and compiled into an aligned set which is temporarily retained on both the trail edge shelf 65 and the side shutters 47. Then each compiled set of sheets may be (optionally) stapled (or otherwise bound) in one corner or along one side at a set binding station such as the stapler 90, located here in the area of a lead edge shelf 62, which is in the same plane as the trail edge shelf 65 and the shutters 47.

As shown particularly in FIGS. 2-9, and as described above in the brief descriptions of those Figs., and as further described below, after a set has been compiled and optionally stapled, the two shutters 47 are then retracted away from one another to allow the compiled set to be dropped down, but in distinct controlled stages, onto the vertically movable (elevator) collection tray 42, or on top of the last preceding set thereon. In this embodiment, the sets collection tray 42 may be vertically movable by, for example, servomotor driven vertical screws 54 at each corner of the tray. A stack height sensor 110 may be used to control the movement of the tray, so that the top of the last finished set of sheets thereon remains at substantially the same level relative to the shutters 47.

Referring again to FIG. 10, an optional or bypass sheet output may also be provided. It may extend from the downstream end of sheet transport 38 by not actuating any of the diverter gates 39 and feeding on via a baffle 56 to a unit 50 with drive rollers 51 to feed the sheets into an output tray 52, as indicated by movement arrows 57 and 53.

In a typical operation, sheets 15 may enter the finishing system 12 one after another at the same rate as they are generated by the document creating apparatus. The drive rollers 35 of the sheet transport assembly 38 move the sheets along a horizontal path 57 to the automatically selected one of the diverter gates 39 that has been actuated to accommodate the particular size of the sheet comprising that set of sheets. The actuated diverter gate 39 directs the sheets onto the two retractable supporting members 47 of the compiler 40. The members 47 are located directly below and substantially parallel to the sheet transport 38. They are positioned adjacent to, but spaced apart from, one another, at locations approximately equidistant from the center of the paper path. Each sheet in a set is placed on top of the other by the above process and aligned by the trail edge tamper 48 and the side tampers until the entire set of sheets is neatly stacked in the compiling and (optional) finishing station 40.

As indicated, once the last sheet of the set of sheets being compiled is guided in and stacked in the compiling area 40, that set of sheets may be stapled 90 and ejected by being deposited onto the underlying sets collection tray 42, where a large quantity of finished sets of sheets may be accumulated. If necessary, the printer may be conventional programmed to skip one print pitch during that compiler unloading operation.

Referring now to FIGS. 1-9, and 11, the movable trail edge (TE) unit, with the sheets trail edge supporting shelf 65 and the trail edge tamping surface 48, also contains a pivotable at 66 trail edge (TE) set clamp arm 59. A pivotable at 68 lead edge (LE) clamp arm 60 is provided as shown under the downstream end of the compiling area 40 (also, a downstream surface 64). These and other operative (movable) components may be controlled by a controller 80. Controller 80 is shown here schematically as a single controller, which may be in control panel 17, but may alternately be separate logic circuits and/or part of an overall finishing module controller. Various suitable movement systems are well know in the art and need not be described herein. For example, the clamp arms 59 and 60 may be solenoid or motor driven up out of the way, and then down onto the top of the set, through various linkages or cable drives, in the order described below and successively illustrated in FIGS. 1-9 and the flow chart of FIG. 11. Various other similar arm movements and arm movement mechanisms are known and patented for the set separators in recirculating document handlers for xerographic copiers.

In the previous compiler/finisher architecture illustrated in the above cross-referenced co-pending earlier applications, there were two separate sheet set drops, first for a partial buffered set, and then, after each set was fully compiled and finished, at a lower level, the compiled set was again dropped, down onto the top of the stack of sets below. The compiled set was dropped in one quick motion all at once by opening narrow movable arms. The sheets or sets were not controlled during that vertical drop, and it was been found that this could resulted in unsatisfactory set-to-set registration and/or in-set sheet registration on the stack after that final drop.

The present embodiment provides positive set gripping control for the set movement from the compile location on the shutters to the sets stack, and does so in a two stage controlled method, not a single free fall drop. (The drop distance 200 may also be reduced, for example, to less than 50 mm.) Positive Lead edge (LE) and trail edge (TE) controls have been provided and the timing has been adjusted to control the set drop by alternating between controlling the trail edge (TE) of the set while the lead edge (LE) drops, and then controlling the LE as the TE drops to the stack. (It will be appreciated that this LE/TE clamping and dropping order could alternatively be reversed to LE/TE.) This added control limits side motion or skewing in the sets that had previously led to unsatisfactory misregistration within the sets and of sets stacking on the set stack.

Figure 2:
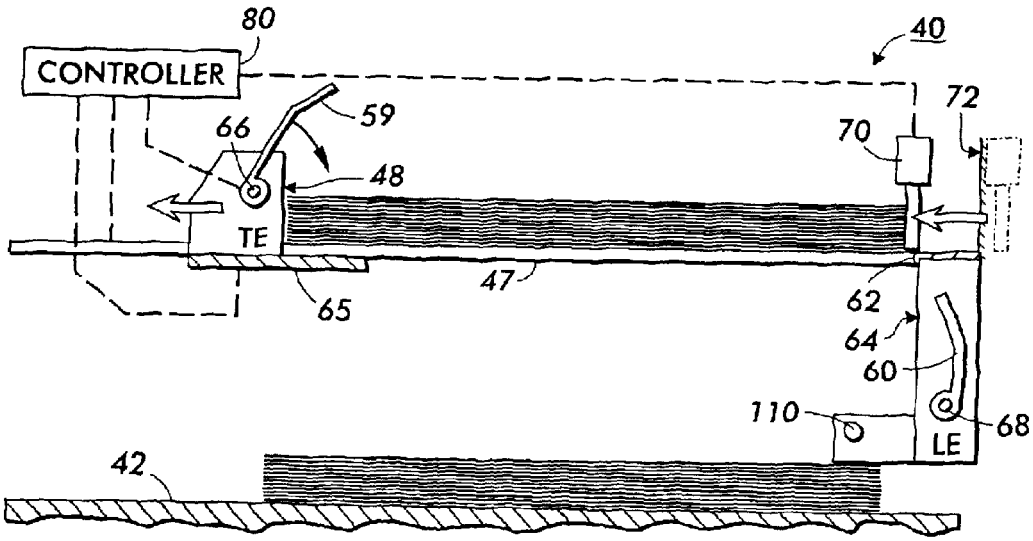

Expressing the same above-described operation in slightly different terminology, after each set is compiled on the shutters as in FIG. 1, the set ejection process begins. As shown in FIGS. 2 and 3, the LE ejector 70 pushes the compiled set LE back from its initial registration edge 72 until the LE shelf 62 no longer supports the LE of the set. At this time the shutters are opened to remove edge support of the set and allow the set LE to drop down to he stack/elevator tray 42 below as in FIGS. 4 and 5.

Figure 4:
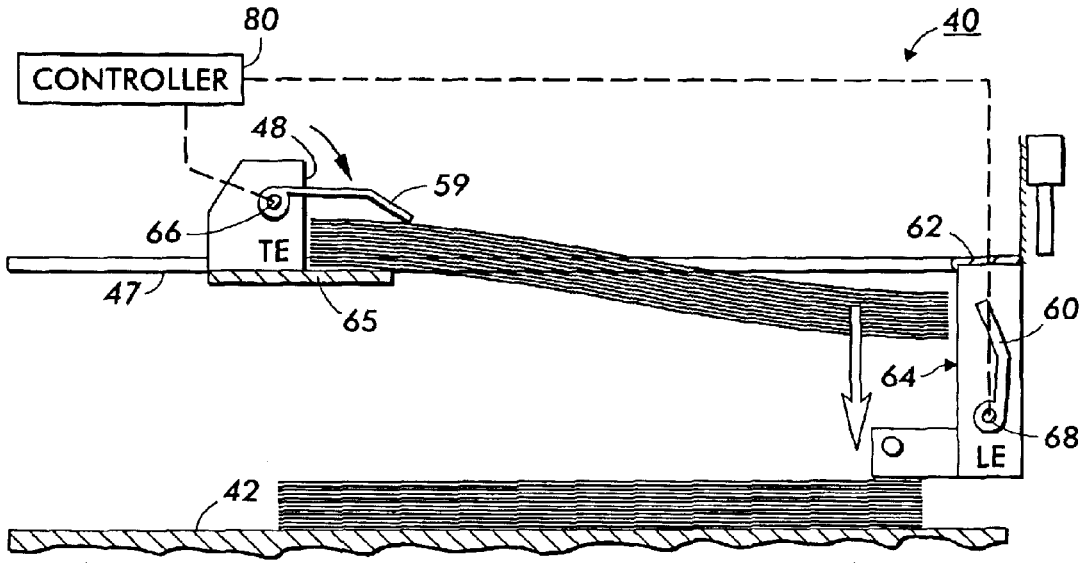
FIG. 4 is the same as FIGS. 1 and 2, but in the next operational step, showing the start of the dropping of the LE of the compiled set in between the now opened shutters while the TE of the set is fully clamped by the TE clamp for set control and the set LE has been pushed back to the end the LE shelf and the LE clamp is in its up or tuck position.
Figure 5:
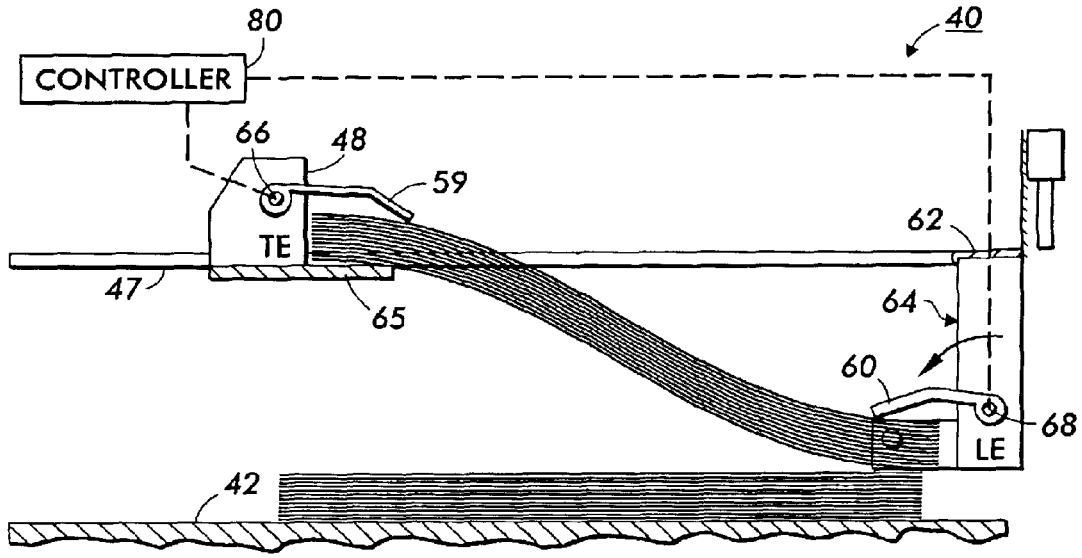
FIG. 5 is the same as FIG. 4, but further along in that operational step, and starting the next step, with the LE of the set (only) having now dropped all the way down on top of the previous stacked set (with a slight set offset), and that set LE now being clamped by the activated LE clamp.
Figure 6:
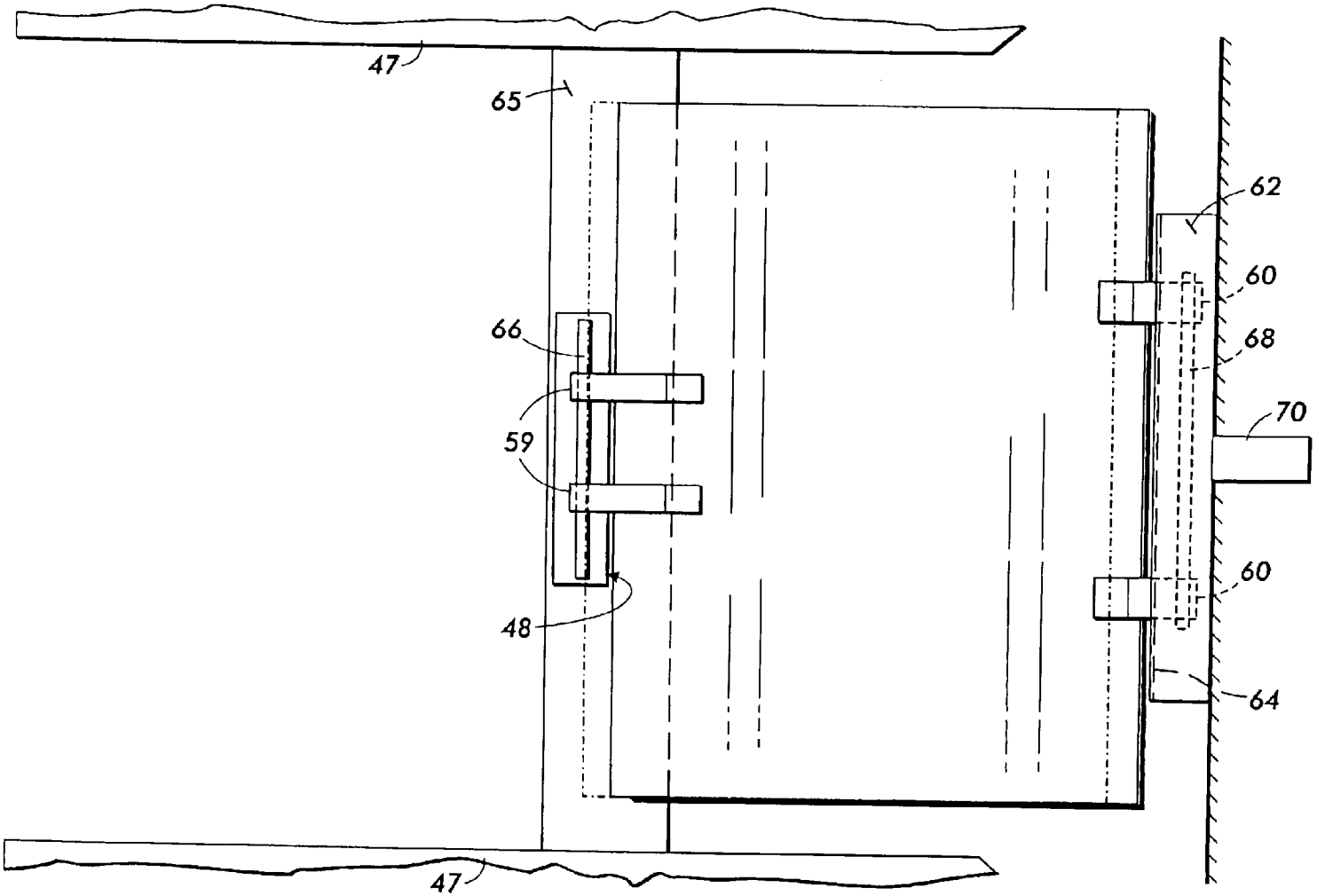
FIG. 6 is a top view of FIG. 5.

Before or as above is happening, the TE tamper unit 48 fully supports the TE of the set on its TE shelf 65 and the set is clamped to that TE shelf 48 by TE clamp 59 as in FIGS. 4-6 to keep the set TE from slipping off of the TE shelf as the LE of the set is being allowed to drop to the stack below (FIG. 4).

Next the LE of the set is clamped down by the LE clamp 60 onto the top of the preceding stacked set to prevent undesired movement of the set while the TE of the set is now dropped from the TE tamper unit 48 as in FIGS. 7 and 8. (FIG. 5). That is, with the LE clamped, the TE of the set is released and the TE tamper and its supporting shelf 48 are pulled out from under the TE of the set to allow the TE of the set to drop to the stack.

With the set now fully on top of the stack, the LE clamp 60 clamping force on the LE of the stack is removed, and the TE tamper unit 48 with its TE shelf 65 is moved back into its initial position to support the sheets led for the next set to be compiled and likewise the shutters 47 have been are moved back in their initial position to hold the new set, as in FIGS. 8 and 9.

At this point the cycle can continue (repeat). The compiling of the next set is illustrated in FIG. 9.

Note the role of the stack height sensor 110 in this process in this embodiment. FIG. 9, for example, is additionally showing the alternate (activated down) LE clamp 60 position in phantom to illustrate how the LE clamp 60 in that position at that time or step blocks the stack height sensor 110. Thus, the LE clamp 60 in that position must be lifted, or move down with the set, to no longer block the stack height sensor 110 in order for the stacking elevator tray 42 height to come to its next rest position. The LE clamp may then open to its solid line raised position, out of the way, ready for the next compiled set LE to drop. Thus, as also shown in FIG. 7, when the set LE is dropping down onto the top of the preceding stacked set on the elevator stack, not only the LE of the added clamped set is now blocking the stack sensor 110 to cause sensor 110 to signal to move the elevator tray 42 down, but the LE clamp 60 is also blocking the sensor 110 until the elevator reaches it's newly lowered height position for the top of the added set and the LE clamp 60 is lifted away from that set. This allows the elevator tray to move down while the LE is still being clamped so that the elevator tray can be moving down while the TE of the set is still dropping. The TE of the set may be largely on top of the stack prior to the elevator move downward. The LE clamp position can function as a stack height sensor. However, it will be appreciated by those skilled in the art that there are other systems of maintaining the top of the last stacked set at the desired relatively constant small distance below the set compiling and finishing area.

This system and process ensures that the sheets of each set, and each set itself, always remains controlled. That is, by alternately positively clamping, and therefor positively controlling, the TE edge and the LE edge of the set during the drop from the compile position to the stack below, misregistrations are minimized within the sets, and between the sets in set stacking, even with fairly rapid dropping of the from a compiling and/or finishing area to the stacking area by a substantial distance.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A method of neatly compiling and stacking print media sheets in discrete sets of said print media sheets comprising:

seriatim receiving and stacking plural print media sheets on a print media sheets compiling and temporary set supporting system until a desired plural number of said print media sheets defining a single said set thereof has been accumulated on said temporary set supporting system;

gripping a first end of said set of print media sheets;

dropping a second and opposite end of said set of print media sheets onto a multiple sets stacking system positioned underneath said print media sheets temporary set supporting system by opening said temporary set supporting system while continuing to grip said first end of said set of print media sheets, to reduce sheet or set scattering;

gripping said second and opposite end of said set of print media sheets at said multiple sets stacking system; and then dropping said first end of said set of print media sheets from said temporary set supporting system onto said multiple sets stacking system while continuing to grip said second and opposite end of said set of print media sheets, to reduce sheet or set scattering.

2. The method of neatly compiling and stacking print media sheets in discrete sets of plural said print media sheets of claim 1, wherein said print media sheets set may be additionally fastened together in said print media sheets compiling and temporary set supporting system.

3. The method of neatly compiling and stacking print media sheets in discrete sets of plural said print media sheets of claim 1, wherein said print media sheets compiling and temporary set supporting system includes a partial supporting shelf for said first end of said set of print media sheets for accomplishing said gripping of said first end of said set of print media sheets by clamping said first end of said set of print media sheets against first end supporting shelf.

4. The method of neatly compiling and stacking print media sheets in discrete sets of plural said print media sheets of claim 1, wherein said print media sheets compiling and temporary set supporting system includes print media sheet side supporting members that open away from one another to drop said set of print media sheets therebetween.

5. The method of neatly compiling and stacking print media sheets in discrete sets of plural said print media sheets of claim 3, wherein said print media sheets compiling and temporary set supporting system includes print media sheet set side supporting members that open away from one another to drop said set of print media sheets therebetween.

6. A system for neatly compiling and stacking print media sheets in sets of plural said print media sheets, comprising:

a print media sheets compiling and set supporting system for seriatim receiving and stacking plural print media sheets on said set supporting system until a desired plural number of said print media sheets defining a single said set thereof has been accumulated on said set supporting system;

means for gripping a first end of said set of print media sheets on said set supporting system;

a multiple sets stacking system positioned below said print media sheets compiling and set supporting system;

means for dropping a second and opposite end of said set of print media sheets onto said multiple sets stacking system by opening said set supporting system while continuing to grip said first end of said set of print media sheets;

means for gripping said second and opposite end of said set of print media sheets; and means for subsequently dropping said first end of said set of print media sheets onto said multiple sets stacking system while continuing to grip said second and opposite end of said set of print media sheets.

7. The system for neatly compiling and stacking print media sheets in sets of plural said print media sheets of claim 6, further including a set fastening system for optionally fastening said set of plural print media sheets together.

8. The system for neatly compiling and stacking print media sheets in sets of plural said print media sheets of claim 6, wherein said print media sheets compiling and set supporting system includes a partial set supporting shelf for said first end of said set of print media sheets, and said means for gripping said first end of said set of print media sheets grips said first end of said set of print media sheets against said partial set supporting shelf.

9. The system for neatly compiling and stacking print media sheets in multiple sets of plural said print media sheets on a multiple sets stacking system of claim 8, wherein said print media sheets temporary set supporting system includes print media sheet opposing side supporting members that open away from one another to drop said set of print media sheets therebetween.

10. The system for neatly compiling and stacking print media sheets in multiple sets of plural said print media sheets on a multiple sets stacking system of claim 8, wherein said print media sheets compiling and temporary set supporting system sequentially compiles said print media sheets on said temporary set supporting system and further includes a set finishing system for binding individual said sets of plural print media sheets together thereon.

11. The system for neatly compiling and stacking print media sheets in multiple sets of plural said print media sheets on a multiple sets stacking system of claim 8, wherein multiple sets of plural said print media sheets stacked on said multiple sets stacking system are stacked offset from one another by offsetting of at least a portion of said print media sheets compiling and temporary set supporting system.

12. The system for neatly compiling and stacking print media sheets in sets of plural said print media sheets of claim 6, wherein said print media sheets compiling and temporary set supporting system includes at least two print media sheet side supporting members that open horizontally away from one another to drop said set of print media sheets therebetween.

13. A system for neatly compiling and stacking print media sheets in multiple sets of plural said print media sheets on a multiple sets stacking system comprising:

a print media sheets compiling and temporary set supporting system for seriatim receiving and stacking a set of plural print media sheets on said temporary set supporting system;

said multiple sets stacking system being positioned below said print media sheets temporary set supporting system;

a first clamping system actuatable to clamp a first end of said set of plural print media sheets on said temporary set supporting system;

said print media sheets temporary set supporting system being openable to drop a second and opposite end of said set of plural print media sheets onto said multiple sets stacking system while said first clamping system is actuated to clamp said first end of said set of plural print media sheets;

a second clamping system for clamping said second and opposite end of said set of plural print media sheets; and said first clamping system being actuatable to release said first end of said set of plural print media sheets to drop said first end of said set of plural print media sheets onto said multiple sets stacking system while said second clamping system is clamping said second end of said set of plural print media sheets.

14. The system for neatly compiling and stacking print media sheets in multiple sets of plural said print media sheets on a multiple sets stacking system of claim 13, wherein said print media sheets temporary set supporting system includes a partial set supporting shelf for said first end of said set of print media sheets, which partial set supporting shelf is part of said first clamping system.

* * * * *